US006046708A

United States Patent [19]

MacDonald, Jr. et al.

[11] Patent Number: 6,046,708

[45] Date of Patent: Apr. 4, 2000

[54] TERMINATION CONTACT FOR AN ANTENNA WITH A NICKEL-TITANIUM RADIATING ELEMENT

[75] Inventors: James D. MacDonald, Jr., Apex; Gerard James Hayes, Wake Forest; John Michael Spall, Raleigh; Walter M. Marcinkiewicz, Apex, all of N.C.

[73] Assignee: Telefonaktiebolaget LM Ericsson, Stockholm, Sweden

[21] Appl. No.: 09/017,658

[22] Filed: Feb. 3, 1998

[51] Int. Cl.[7] ..... H01Q 1/50

[52] U.S. Cl. ..... 343/906; 343/872; 343/873

[58] Field of Search ..... 343/872, 873, 343/906, 713, 700 MS; H01Q 1/50

[56] References Cited

U.S. PATENT DOCUMENTS 4,788,553 11/1988 Phillips ..... 343/786

5,401,901 3/1995 Gerry et al. ..... 174/35 MS 5,748,155 5/1998 Kadunce et al. ..... 343/713

5,885,381 3/1999 Mitose et al. ..... 148/564

*Primary Examiner*—Don Wong

*Assistant Examiner*—Shih-Chao Chen

*Attorney, Agent, or Firm*—Burns, Doane, Swecker & Mathis, L.L.P.

[57] ABSTRACT

A termination contact for an antenna that has a Ni—Ti radiating element is formed by a layer of electrically conductive carbon filler disposed on the Ni—Ti radiating element. A conductive element is positioned on the layer of conductive carbon filler to provide electrical interface between the Ni—Ti radiating element and external RF circuitry. In to prevent contamination, a protective layer of silicon elastomer covers the conductive layer and the Ni—Ti radiating element such that a portion of the conductive element is exposed to provide a RF feed point.

16 Claims, 2 Drawing Sheets

TERMINATION CONTACT FOR AN ANTENNA WITH A NICKEL-TITANIUM RADIATING ELEMENT

BACKGROUND

This invention generally relates to the field of antennas, more particularly, to an antenna that uses a Nickel-Titanium (Ni—Ti) radiating element.

The explosive growth of cellular radiotelephone systems has resulted in extensive use and handling of mobile phones by subscribers. One of the important considerations in designing a small communication device, such as a cellular phone, is the physical characteristics of its antenna and the interconnecting mechanism used to interface the antenna with radio frequency (RF) circuitry at a termination contact. Typically, it is desirable to design a thin antenna with a termination contact that can withstand day-to-day handling, including occasional mishandling.

In order to survive handling abuse, some conventional antennas use a rigid radiating element that is over-molded with flexible material. The over-mold material is used to limit bending of the rigid radiating element and to evenly distribute the bending stresses between rigid and flexible sections. The use of rigid radiating elements, however, limits the size and flexibility of the antenna. Instead of rigid radiating elements, Ni—Ti radiating elements, which have low electrical resistance and high flexural properties, have been used in antennas. The flexural properties of Ni—Ti radiating elements makes them specifically suitable for cellular phone antennas, which must tolerate dropping and extreme bending without permanent distortion. The flexural properties of Ni—Ti radiating elements are obtained by heat treating to create a specific phase structure. Subsequent mechanical working of the material, such as rolling or forming, creates a suitable material modulus that gives Ni—Ti alloy its properties.

Termination contacts, which provide an electrical interface with RF circuitry, may be positioned at various points along the antenna. For example, termination contacts may be positioned on transmission lines, RF connectors, ground planes, tuning structures, or multiple radiating elements. Conventional antennas employ one of three types of termination contacts: metallic contacts, crimp type compressive contacts, and metal filled conductive polymer contacts. However, for the reasons given below, these contacts are not optimized for Ni—Ti radiating elements.

The Ni—Ti alloy is difficult to join via soldered, brazed, or welded metallic contacts. This is because heating of the Ni—Ti alloy to high temperatures needed for soldering, brazing or welding destroys the mechanically induced temper and may also change the phase structure. Moreover, when sufficiently heated, the surface of the Ti—Ni alloy forms a naturally stable oxide surface of titanium known as RUTILE, which resists wetting by most common solders.

Due to problem with metallic contacts, crimp type compressive contacts are the most common contact system for antennas with Ni—Ti radiating elements. Crimp type compressive contacts are formed by a metallic element suitable for crimping, such as stainless steel or copper beryllium alloy, which is mechanically deformed to create a compressive contact. Under this arrangement, the interface metal must resist deterioration caused by moisture borne environmental contaminants. Typically gold or nickel metallization systems are used to ensure an electrochemically stable contact. However, the cost of corrosion resistant metallization with precious metals is relatively high. Furthermore, the size of the compressive contact is driven by the contact pressure required to insure exclusion of moisture during the life of the antenna, which limits its minimum size.

For metal filled conductive polymers contacts, epoxies filled with conductive metals such as silver or gold are commonly used. However, the epoxy resins are rigid and limit flexibility. Consequently, plasticizer additives are used to increase elastic properties. These additives suffer from changing physical properties over time, generally decreased flexibility from aging or loss of the plasticizer. Because the electrical interconnection is formed by surface contact of the metal particles in the polymer matrix, changing physical properties produce shifts in the electrical conductivity. Moreover, polymer compounds with chemically active metal fillers, such as silver, frequently suffer from electromigration in humid conditions where free electrolytes from the environment are present, causing changes in the contact resistance over time.

Accordingly, a termination contact for an antenna that incorporates a Ni—Ti radiating element is needed that is mechanically and electrically stable over time. The termination contact for such antenna should withstand environmental extremes and mechanical stresses common to hand held cellular phones during its operational life. It is also desired for the contact to have minimum volume to meet miniaturization requirements and be adaptable to high volume automated manufacturing.

SUMMARY

The present invention that addresses this need is exemplified in a termination contact for an antenna that has a Ni—Ti radiating element. According to the present invention, the termination contact is formed by a layer of acrylic adhesive with an electrically conductive carbon filler disposed on the Ni—Ti radiating element, and a conductive element that is positioned on the layer of conductive carbon filler. A protective layer, for example, a layer of silicon elastomer, covers the Ni—Ti radiating element and the conductive element to prevent contamination. Preferably, the protective layer covers the conductive element such that a portion of the conductive element is exposed to provide a RF feed point. According to a more detailed feature of the invention, the conductive element, which may be made of copper, is plated to provide mechanical and electrical stability at the RF feed point.

Other features and advantages of the present invention will become apparent from the following description of the preferred embodiment, taken in conjunction with the accompanying drawings, which illustrate, by way of example, the principles of the invention.

DETAILED DESCRIPTION

Figure 1:
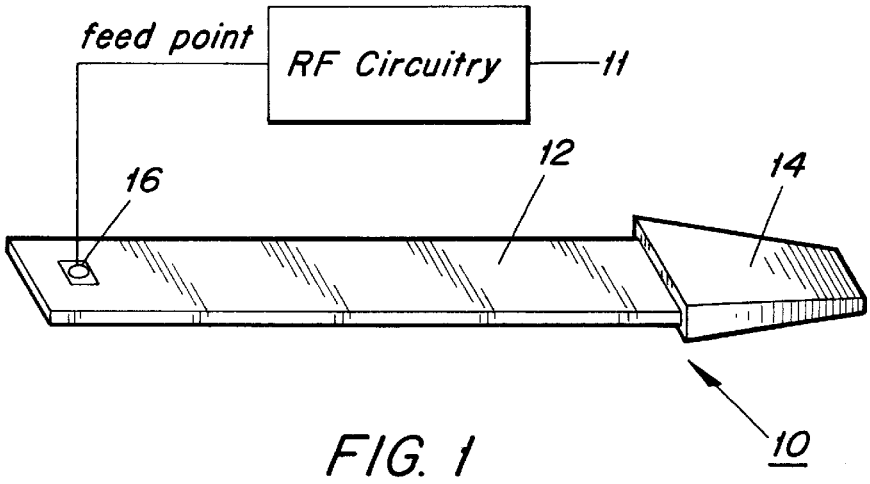
FIG. 1 is an isometric view of the antenna that advantageously uses the termination contact of the present invention.

Referring to FIG. 1, an isometric view of an antenna 10 that uses a termination contact according to the present invention is shown. In an exemplary embodiment, the antenna 10 is a dual band retractable antenna that is used in a mobile communication device, such as a cellular telephone (not shown). As its main body, the antenna 10 includes a thin antenna blade 12. A protective molded end cap 14, for example, one made of plastic, is attached to one end of the blade 12. At the other end, a termination contact 16, which is configured according to the present invention, provides the interface between antenna 10 and RF circuitry 11 of the communication device.

Figure 2:
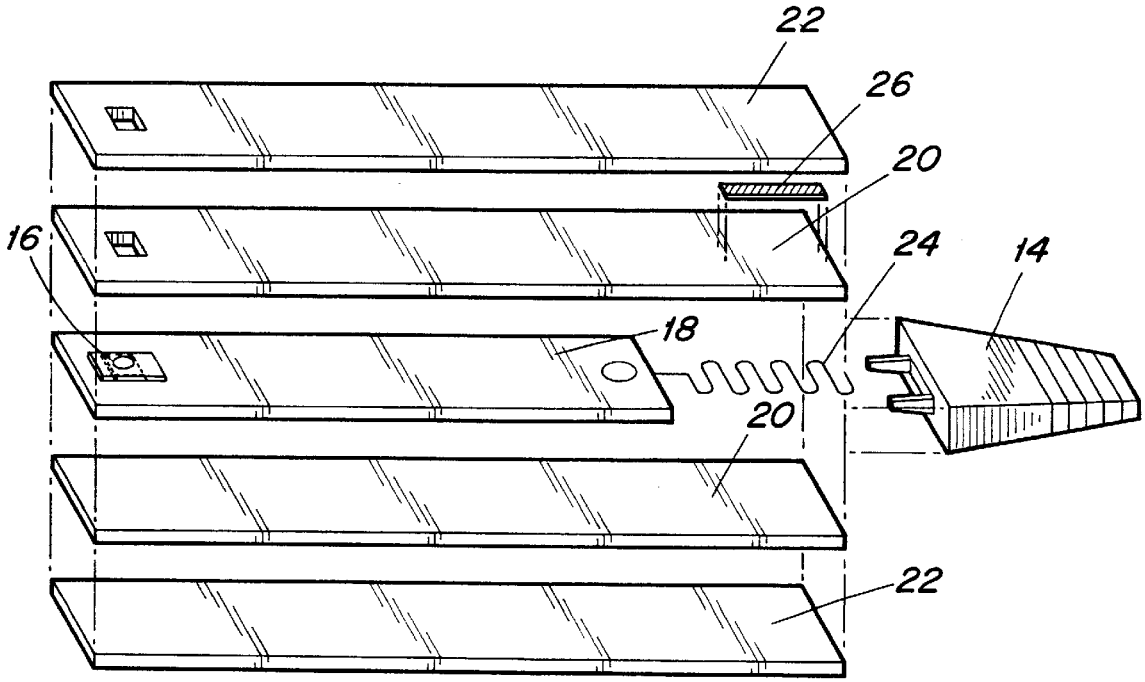
FIG. 2 is an exploded view of the antenna of FIG. 1.

Referring to FIG. 2, an exploded view of the antenna 10 is shown. The antenna 10 includes a radiating element 18, dielectric layers 20 and outer jackets 22. The radiating element 18 is made of a flat strip of Ni—Ti super flexural alloy. Preferably, the dielectric layers 20 are silicone elastomer dielectric layers that are disposed at opposing surfaces of the Ni—Ti radiating element 18. At one end, the Ni—Ti radiating element 18 terminates in a wire meander 24 in the upper portion of the antenna 10. The wire meander 24 is formed of round copper wire but could also be formed by a stamped, etched, plated, or deposited means. In an exemplary embodiment, a tuned parasitic metallic element 26 is positioned on the wire meander 24, over one of the dielectric layers 20 covering the radiating elements 18 to create dual band performance for the antenna 10.

Figure 3:
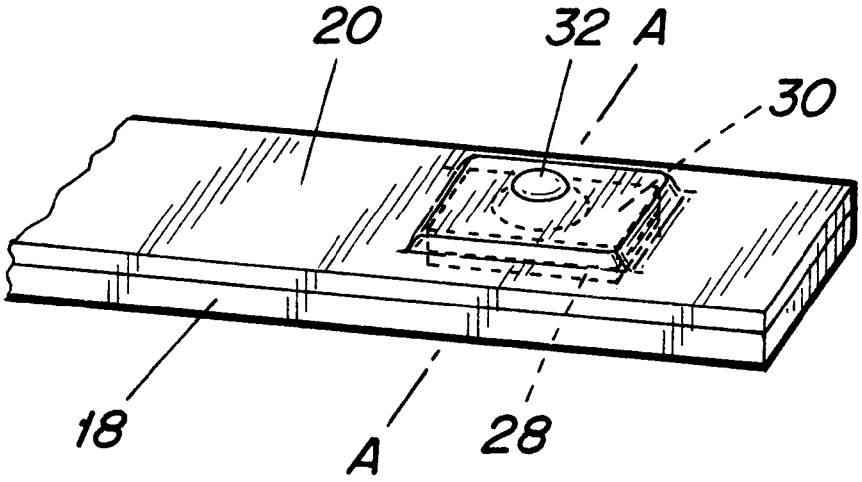
FIG. 3 is an isometric view of a termination contact according to the present invention.

Referring to FIG. 3, a partial isometric view of the antenna 10 illustrates the termination contact 16, which is disposed at the other end of the Ni—Ti radiating element 18. The termination contact 16 is exposed on the exterior surface of the antenna 10 and interconnects the Ni—Ti radiating element 18 at a feed point to the RF circuitry 11 of FIG. 1. As described above, the electrical interconnection provided by the termination contact 16 must survive high pressure contact wiping from repeated extensions and retractions that the antenna 10 may be subjected to during its operational life. According to the present invention, the termination contact 16 is electrically connected to the Ni—Ti radiating element by a conductive pressure sensitive adhesive layer 28, which uses a flexible acrylic polymer with a stable non-metallic carbon filler as matrix. The carbon filler, which substitutes silver or gold particles in conventional matrix, provides high conductivity via a suitable chain of carbon within the filler. One such conductive carbon filler is known as Dev 8257 manufactured by Adhesives Research, Inc. A conductive element 30 is positioned on top of the carbon filled adhesive layer 28. Under this arrangement, the Ni—Ti radiating element 18 conductively interfaces with the RF circuitry through the conductive element 30 and carbon filled adhesive layer 28. Accordingly, the termination contact of the invention provides a low resistance ohmic contact, which is mechanically and electrically stable over time.

To withstand environmental extremes and mechanical stresses, an outer layer of silicone elastomer is used as an environmental barrier. The silicone elastomer is permeable to water vapor but does not readily transport ionic contaminants. Under this arrangement, the thickness of the silicone elastomer layers 20 is adjusted to ensure a suitable barrier for the operational life of the antenna 10. Except for an exposed portion, 32 the silicon elastomer layer 20 covers the conductive element 30 and the Ni—Ti radiating element 18 to prevent contamination. In this way, the exposed portion 32 of the conductive element 30 provides the feed point of the antenna 10. Preferably, the exposed portion of the conductive element 30 is formed of copper alloy with a suitable plating to assure a stable resistance value.

Figure 4:
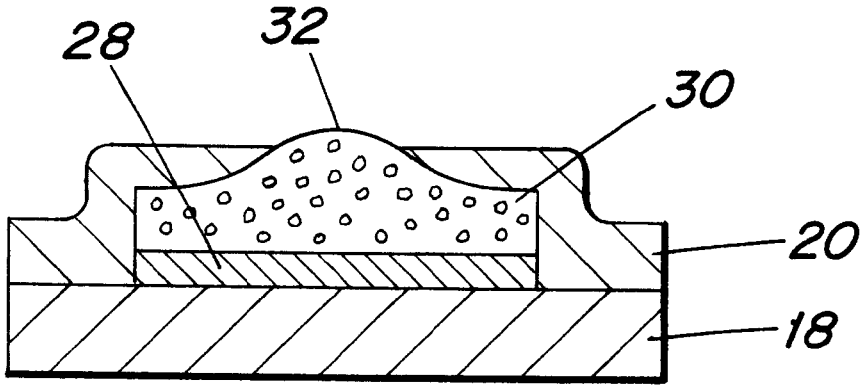
FIG. 4 is a partial cross-sectional view of the termination contact of FIG. 3.

Referring to FIG. 4, a cross sectional view of the termination contact 16 along a latitudinal axis A—A (of FIG. 3)is shown for describing method of fabricating the antenna 10 according to the present invention. As shown, the termination contact 16 is formed by disposing the carbon filled adhesive layer 28 on the Ni—Ti radiating element 18. Preferably, the carbon filled adhesive layer 28 is disposed on the Ni—Ti radiating element 18 by an automated adhesive transfer tape process. Then, the conductive element 30, which may be plated with nickel or gold, is positioned on top of the carbon filled adhesive layer 28. Finally, silicone elastomer over-coating layer 20 is applied for environmental protection and mechanical flexibility. The silicone elastomer layers 20 bond with the radiating elements 18 upon application of pressure or heat.

From the foregoing description it would be appreciated that the present invention provides a durable termination contact, which can withstand mechanical stresses common to portable cellular phones, while using a fraction of the volume of a conventional crimp connection. The termination contact of the invention is thinner and more flexible than conventional contacts due to the flexibility of the carbon filled adhesive and the silicon elastomer layers. Also, the carbon filled adhesive layer does not suffer from the same degree of physical property changes compared to conventional epoxy systems, and the use of the adhesive system in the form of an adhesive transfer tape is adaptable to high volume automated manufacturing. Furthermore, material cost for the termination contact of the invention is reduced by replacing precious metals, such s gold or silver, with carbon as a conductive filler.

Although the invention has been described in detail with reference only to he presently preferred embodiment, those skilled in the art will appreciate that various modifications can be made without departing from the invention. Accordingly, the invention is defined only by the following claims which are intended to embrace all quivalents thereof.

What is claimed is:

1. A termination contact for an antenna having a Ni—Ti radiating element, comprising:

a layer of electrically conductive carbon filler disposed on the Ni—Ti radiating element; and a conductive element positioned on the layer of conductive carbon filler.

2. The termination contact of claim 1 further including a protective layer covering the Ni—Ti radiating element and the conductive element to prevent contamination.

3. The termination contact of claim 2, wherein the protective layer covers the conductive element such that a portion of conductive element is exposed to provide a RF feed point.

4. A termination contact for an antenna having a Ni—Ti radiating element, comprising:

a layer of electrically conductive carbon filler disposed on the Ni—Ti radiating element;

a conductive element positioned on the layer of conductive carbon filler; and a protective layer covering the Ni—Ti radiating element and the conductive element to prevent contamination, wherein the protective layer is a layer of silicon elastomer.

5. The termination contact of claim 1, wherein the conductive element includes copper.

6. The termination contact of claim 1, wherein the conductive element is plated.

7. An antenna, comprising:

a Ni—Ti radiating element;

a silicon elastomer layer bonded to the Ni—Ti radiating element; and a termination contact including:

a layer of electrically conductive carbon filler disposed on the Ni—Ti radiating element; and a conductive element positioned on the layer of electrically conductive carbon filler, wherein the silicon elastomer dielectric layer forms a protective layer covering the Ni—Ti radiating element and the conductive element to prevent contamination.

8. The antenna of claim 7, wherein the silicon elastomer layer covers the conductive element such that a portion of conductive element is exposed to provide a RF feed point.

9. The antenna of claim 7, wherein the conductive element includes copper.

10. The antenna of claim 7, wherein the conductive element is plated.

11. The antenna of claim 7 further including an outer jacket providing an exterior surface for the antenna.

12. A method of fabricating an antenna comprising the steps of:

disposing a layer of conductive carbon filler on a Ni—Ti radiating element; and positioning a conductive element on the layer of conductive carbon filler.

13. The method of claim 12 further including the step of at least partially covering the Ni—Ti radiating element and conductive element with a protective layer to prevent contamination.

14. The method of claim 12 further including the step of exposing a portion of the conductive element to provide a RF feed point.

15. The method of claim 12 further including the step of plating the conductive element.

16. The method of claim 12, wherein the conductive element includes copper.

* * * * *